United States Patent [19]

Cade

[11] 4,113,419

[45] Sep. 12, 1978

[54] BURNER CONTROL APPARATUS

[75] Inventor: Phillip J. Cade, Winchester, Mass.

[73] Assignee: Electronics Corporation of America, Cambridge, Mass.

[21] Appl. No.: 675,778

[22] Filed: Apr. 12, 1976

[51] Int. Cl.[2] ..... F23N 5/00; H01N 7/00

[52] U.S. Cl. ..... 431/78; 307/141; 431/79; 236/46 F

[58] Field of Search ..... 431/27, 78, 79, 80, 431/72, 69; 328/129; 307/117, 141; 236/1 A, 15 BG, 15 E, 46 R, 46 E, 46 F; 237/2 A

[56] References Cited

U.S. PATENT DOCUMENTS

| | | | |
|---|---|---|---|
| 3,315,891 | 4/1967 | Allen | 236/46 |
| 3,376,099 | 4/1968 | Giuffrida et al. | 431/79 X |
| 3,482,922 | 12/1969 | Biackett | 431/79 X |
| 3,720,858 | 3/1973 | Mercier | 307/141 |
| 3,727,073 | 4/1973 | Cade | 307/117 |
| 3,820,938 | 6/1974 | Deif et al. | 431/78 |
| 3,829,276 | 8/1974 | Lenski et al. | 431/79 X |
| 3,840,322 | 10/1974 | Cade | 307/117 X |
| 3,852,729 | 12/1974 | Cade | 307/117 X |
| 3,861,854 | 1/1975 | Walbridge | 431/80 |
| 3,947,220 | 3/1976 | Dietz | 431/27 |

FOREIGN PATENT DOCUMENTS

| | | | |
|---|---|---|---|
| 2,453,170 | 5/1975 | Fed. Rep. of Germany | 431/78 |

*Primary Examiner*—Edward G. Favors
*Assistant Examiner*—Larry Jones

[57] ABSTRACT

Burner control apparatus includes a control device for actuating an ignition control means, and a timing circuit for providing an ignition timing interval of precise duration. The timing circuit is actuated in response to a request for burner operation and the control device is energized in response to the actuated timing circuit. The control device is maintained energized if a signal from the flame sensor is received before the end of the ignition timing interval, and the control device is deenergized and lockout circuitry is energized in the absence of a signal from the flame sensor.

37 Claims, 3 Drawing Figures

FIG I

BURNER CONTROL APPARATUS

SUMMARY OF THE INVENTION

This invention relates to electrical control circuitry and more particularly to electrical control circuitry particularly adapted for use in burner control systems.

Burner control systems are designed both to monitor the existence of flame in the supervised combustion chamber and to time sequences of operation of burner controls. Safety of burner operation is a prime consideration in the design of burner control systems. For example, if fuel is introduced into the combustion chamber and ignition does not take place within a reasonable time, an explosive concentration of fuel may accumulate in the combustion chamber. The burner control system should reliably monitor the existence of flame in the combustion chamber, accurately time a trial-for-ignition interval, inhibit ignition if a false flame signal is present, and shut down the burner in safe condition whenever a potentially dangerous condition exists. Examples of such burner control systems are disclosed in my U.S. Pat. No. 3,840,322.

Among the considerations in burner control system design are reliability of operation, manufacturing cost, the provision of precise timing cycles (particularly those of short duration), and the nature of the response of the burner control to a flame failure condition after flame has been established, for example, an immediate shut down of the burner system, an immediate attempt to re-establish flame, or an attempt to re-establish flame only after a pre-ignition (purge) interval.

In accordance with one aspect of the invention, there is provided a burner control apparatus for use with a fuel burner installation that has an operating control to produce a request for burner operation, a flame sensor to produce a signal when flame is present in the monitored combustion chamber, and one or more devices for control of ignition and/or fuel flow. The burner control apparatus comprises lockout apparatus for de-energizing the control apparatus, a control device for actuating the ignition and/or fuel control devices, and a timing circuit that provides two successive timing intervals of precise duration and that includes a common capacitor, one of the timing intervals being a function of the charging of the common capacitor and the other timing interval being a function of the discharging of the common capacitor. An ignition sequence is commenced in response to a request for burner operation by actuating the timing circuitry and that timing circuitry energizes the control device at the end of the first timing interval and then provides an ignition timing interval during which the flame should be established in the supervised combustion chamber. If flame is established during that ignition timing interval, the flame signal responsive circuitry maintains the control device energized. If flame is not established during that timing interval, the lockout apparatus operates to de-energize the control apparatus. Circuitry coupled to the timing circuit prevents a further timing interval until flame has been established, and the system includes means responsive to the loss of a flame signal from the flame sensor after flame has been established to cause the timing circuit to provide at least a further ignition timing interval.

The circuitry to prevent further timing intervals in one embodiment includes a latching arrangement which maintains the common capacitor discharged, while in another embodiment the common capacitor has a charge stored on it and the existence of a flame signal prevents the timing circuit from responding to the stored charge.

In accordance with another feature, there is provided burner control apparatus that includes lockout circuitry arranged for connection directly to a power supply so that the lockout circuitry is energized independently of a request for burner operation. Control circuitry includes a timing circuit for providing an ignition timing interval, a control device for actuating a fuel control, the control circuitry being connected to energize both the control device and the lockout circuitry in response to a request for burner operation. The circuitry responds to a signal from the flame sensor when the control device is not energized to energize the lockout circuitry and to prevent energization of the control device, and responds to a signal from the flame sensor when the control device is energized by the control circuitry to maintain the control device energized without energization of the lockout circuitry. There is also provided means responsive to the end of an ignition timing interval to de-energize the control device and to energize the lockout circuitry in the absence of the signal from the flame sensor. This apparatus is particularly useful in connection with flame sensors of the ultraviolet type, this circuitry providing a system for monitoring the flame sensor during off heat intervals (in the absence of a request for burner operation signal) and locking out the burner system and energizing an alarm should a spurious flame signal be generated for a significant interval of time during any such off heat interval, the circuitry providing a reliable arrangement and integrating the lockout circuitry in a simple circuit arrangement with the control circuitry for controlling timing intervals and the energization of ignition and fuel controls.

In accordance with another aspect, there is provided a burner control apparatus that includes lockout circuitry that has an actuator with first and second alternate lockout actuator energizing paths, a main control actuator and an actuator for the pilot fuel control, the pilot and main control actuators being connected in one of the lockout actuator energizing paths. Circuitry responsive to a signal from the flame sensor maintains the main control energized without energization of either the lockout actuator or the pilot fuel control, and circuitry operative in the absence of a signal from the flame sensor at the end of a timing interval completes the other lockout actuator energizing path. In this circuit arrangement, the pilot fuel control is actuated only during an ignition timing interval.

In accordance with still another aspect, there is provided flame signal processing circuitry that includes a gating transistor. Connected to the control electrode of the gating transistor is a voltage limiting device that is switched between a positive potential (when the main control is not energized) and a ground potential (when the control device is energized). When the voltage limiting device is connected to the positive potential, the flame signal processing circuitry is rendered unresponsive to signals from the flame sensor, while in the second condition, the flame sensing circuitry is responsive to signals from the flame sensor. This circuit arrangement is particularly useful in burner installations of the type that employ a standing pilot, and with a simple modification is suitable for use with systems without a standing pilot which monitor for a false flame signal. The control is accomplished in a low impedance circuit, rather than the high impedance input side between the gating transistor and the flame sensor.

In accordance with still another aspect, there is provided compensation in the flame signal responsive circuitry for a drop in supply voltage when a low impedance circuit is completed, this circuit including a lockout actuator and a control relay actuator and being of low impedance to provide sufficient current flow to pick up the control relay. This large current flow reduces the supply voltage to the flame sensing circuitry. The power supply provides a reference voltage to the flame signal responsive circuitry which establishes a threshold for flame signals and a shift in this reference voltage affects the sensitivity of the flame sensing circuitry. In the improved circuit, there is provided power supply compensation responsive to the concurrent energization of the lockout actuator and the control device to stabilize the reference voltage and thus the sensitivity of the flame signal responsive circuitry. In preferred embodiments this power supply compensation is provided by connecting a component of the voltage reference circuit in series with the circuit of the lockout actuator and the control device to which provides an upward voltage shift as compensation for the reduced supply voltage level produced by the energization of that circuit.

Other objects, features and advantages of the invention will be seen as the following description of particular embodiments progresses, in conjunction with the drawings, in which.

DESCRIPTION OF PARTICULAR EMBODIMENTS

Figure 1:
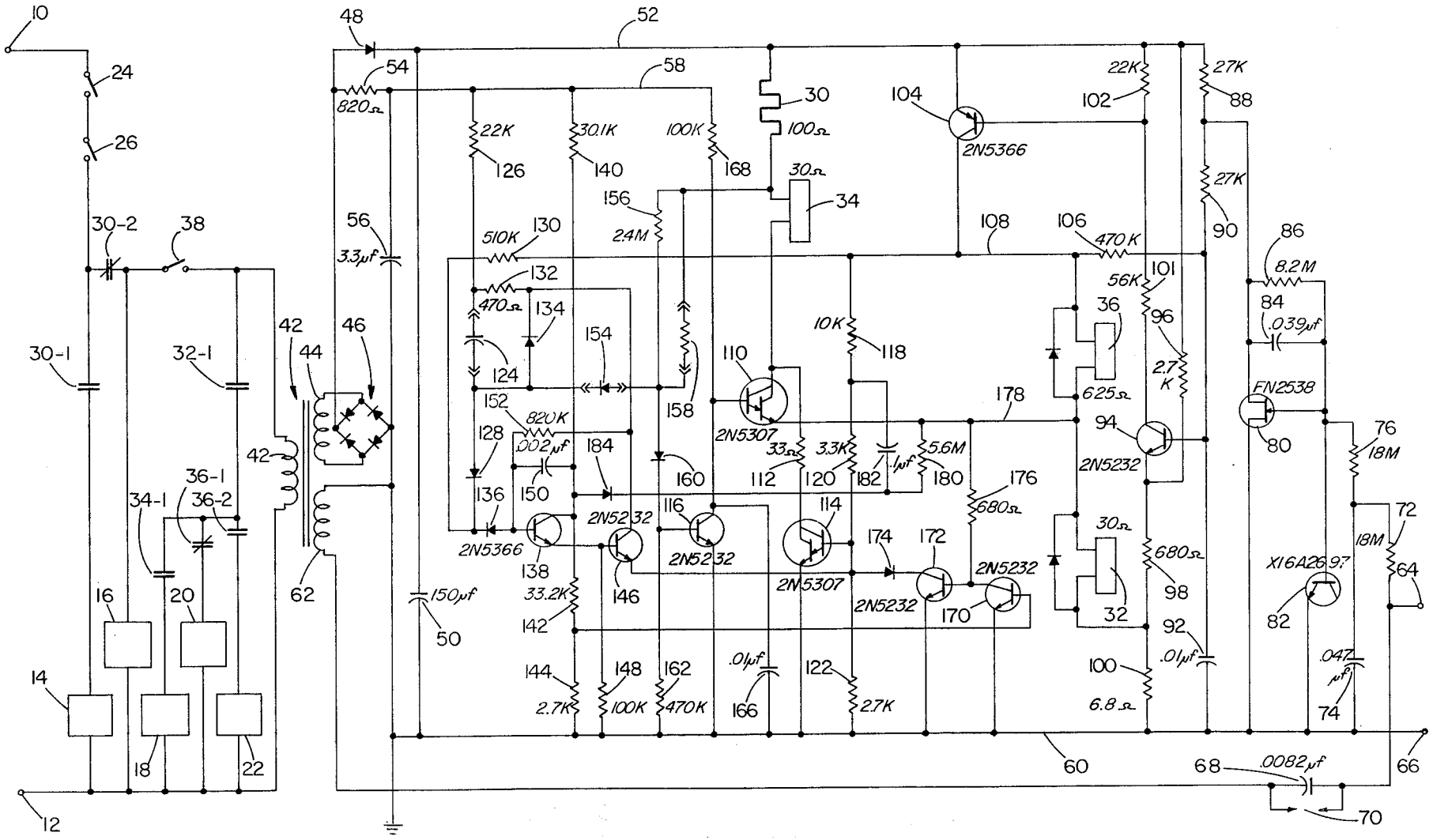
FIG. 1 is a schematic diagram of a burner control system constructed in accordance with aspects of the invention.

With reference to FIG. 1, the illustrated burner control arrangement includes terminals 10, 12 adapted to be connected to a suitable source of power, a typical source being a 120-volt, 60-Hertz source. Connected to those terminals is a control section that includes alarm device 14, blower 16, pilot fuel control 18, spark ignition control 20, and main fuel control 22. Limit switch 24 and operating control 26 such as a thermostat are connected in series to terminal 10. Normally open lockout contacts 30-1 are connected in series with alarm device 14 and normally closed lockout contacts 30-2 are connected in series between operating control 26 and the other devices of the control section. Normally open control relay contacts 32-1 control the application of power to the ignition and fuel controls 18, 20 and 22; normally open auxiliary relay contacts 34-1 are connected in series with pilot fuel control 18; normally closed flame relay contacts 36-1 are connected in series with the ignition control 20; and normally open flame relay contacts 36-2 are connected in series with main fuel control 22. Switch 38 is closed in response to air flow produced by blower 16 and is connected in series with primary winding 40 of transformer 42. A first secondary winding 44 of transformer 42 has a full wave rectifier 46 connected across its terminals to provide DC power for the electronics section, that power being applied through diode 48 to main bus 52 and through resistor 54 to auxiliary bus 58. A secondary winding 62 of transformer 42 applies power to terminals 64, 66 to which a flame sensor of the flame rod type is connected.

The flame sensor circuitry includes coupling capacitor 68 bridged by protective gap 70, and a resistive capacitive input network that couples a flame signal as terminal 64 to field effect transistor 80 whose gate is connected via voltage limiting diode 82 to ground bus 60. Diode 82 functions as a Zener diode and limits the negative swing of the gate of transistor 80 to about seven volts. Field effect transistor 80 is connected through a second RC network to a second transistor 94 that has a reference voltage applied to its emitter by a voltage divider network of resistors 96, 98 and 100. Turn on of transistor 94 in response to a flame signal turns on transistor 104 to apply power from B+ bus 52 to bus 108.

Lockout circuitry connected to bus 52 includes a thermally responsive lockout actuator 30 and two actuating circuits, a first actuating circuit through Darlington pair 110, control relay actuator 32 and resistor 100 to ground bus 60 and a second actuating circuit through resistor 112 and Darlington pair 114 to ground bus 60. Auxiliary relay coil 34 is connected in series with lockout actuator 30 and is energized whenever actuator 30 is energized. (In an alternative circuit arrangement coil 34 may be connected in bus 178 between Darlington pair 110 and control relay actuator 32.) The control electrode of Darlington pair 110 is connected to transistor 116 while the control electrode of Darlington pair 114 is connected to a voltage divider network of resistors 118, 120 and 122 connected between flame signal bus 108 and ground bus 60.

Connected to auxiliary bus 58 is a timing circuit that includes tantalum timing capacitor 124 whose positive terminal is connected to bus 58 through resistor 126 and whose negative terminal is connected to bus 108 through diode 128 and resistor 130. Connected across timing capacitor 124 are resistor 132 and diode 134. Connected to the junction between diode 128 and resistor 130 via diode 136 is the base of transistor 138 whose collector is connected to a voltage divider network that includes resistors 140, 142 and 144. The collector of transistor 138 is connected to the base of transistor 146. Capacitor 150 is connected between the emitter and base of transistor 138, while resistor 152 is connected between the collector of transistor 146 and the base of transistor 138.

Connected between the negative terminal of timing capacitor 124 and lockout actuator 30 is a network of diode 154 and resistors 156 and 158. Diode 160 connects diode 154 to the base of transistor 116. Darlington pair 110 is triggered into conduction by the turn off of transistor 116.

Circuitry for control of Darlington pair 114 includes transistors 170, 172, the collector of transistor 172 being connected via diode 174 to the control electrode of Darlington pair 114. Darlington pair 114 is triggered into conduction in response to a flame signal on bus 108 applied through voltage divider network of resistors 118, 120, and 122 or conduction or transistor 146 unless its control electrode is clamped to ground by transistor 172 in conduction. The base of transistor 172 is connected by resistor 176 to line 178.

An unlatching network, responsive to loss of signal on bus 108, includes resistor 180, coupling capacitor 182 and diode 184 and is connected to the emitter of transistor 138. Timing capacitor 124, diode 154 and resistor 158 are mounted on a plug in timing card and enable the pre-ignition and trial-for-ignition time intervals to be readily changed. The following are values of particular cards for use in this embodiment:

| Capacitor 124 | Resistor 158 | Pre-Ignition | Trial-for-Ignition |
|---|---|---|---|
| 15 uf | 750 K | 7 sec. | 10 sec. |
| 68 uf | 150 K | 30 sec. | 10 sec. |
| 180 uf | 47 K | 90 sec. | 10 sec. |

In operation, limit switch 24 is normally closed, and in response to a call for burner operation, switch 26 closes and power is applied to the control section. Blower 16 is energized through normally closed lockout contacts 30-2. When air flow switch 38 closes, power is applied via transformer 42 and rectifier 46 to the electronics section. The electronics section times two successive intervals, a first (pre-ignition) interval in which capacitor 124 is charged and a second (ignition) interval in which the capacitor 124 is discharged. As capacitor 124 charges, the voltage at the junction between diodes 128 and 136 drops towards the voltage on ground bus 60, controlling the first (pre-ignition) time delay interval as a function of the RC values in that capacitor charging circuit (through resistor 130, relay actuators 36 and 32, and resistor 100). When the voltage at that junction has dropped sufficiently, transistor 138 turns on, the resulting current flow turns on transistor 146 and a signal is fed back through resistor 152 to maintain (latch) transistor 138 in conducting condition. Conduction of transistor 146 abuptly drops the voltage on the plus side of capacitor 124. This voltage transition is coupled by diodes 154 to 160 to turn off transistor 116 and to turn on Darlington pair 110. As a result, current flows through a low resistance path of lockout actuator 30, auxiliary relay actuator 34, Darlington pair 110, line 178, control relay actuator 32 and resistor 100. Relays 32 and 34 are pulled in, closing contacts 32-1 and 34-1 and energizing pilot fuel control 18 and ignition control 20, establishing an ignition condition in the supervised combustion chamber. Transistor 170 is turned off by conduction of transistors 138 and 146 and the signal on line 178 is coupled by resistor 176 to turn transistor 172 on, clamping the control electrode of Darlington pair 114 to ground and thus holding the alternate lockout actuator energizing path non-conductive. The voltage rise at the junction of resistor 100 and relay actuator 32 compensates for the voltage drop on supply bus 52 which occurs when the low resistance path through Darlington pair 110 is conductive so that there is no marked change in the reference voltage at the emitter of transistor 94 and thus stabilizes the response of the flame sensing circuitry to signals at terminal 64.

In the ignition timing interval, capacitor 124 discharges at a rate determined essentially by the value of capacitor 124 and resistor 158. The potential on the base of transistor 116 rises and when transistor 116 is turned on, Darlington pair 110 is turned off, terminating the second (ignition) interval. In normal operation, during this discharging interval of capacitor 124 and prior to the turn off of Darlington pair 110, flame is established and a flame signal from the flame sensing circuitry is applied at the base of transistor 104, turning on that transistor and applying the B+ voltage to bus 108. The flame relay actuator 36 is energized and an alternate path for maintaining control relay actuator 32 energized is established. Pickup of flame relay 36 opens contacts 36-1, de-energizing the igniter control 20, and closes contacts 36-2 energizing the main fuel control 22. Heating of lockout actuator 30 ceases when Darlington pair 110 is turned off and auxiliary relay 34 is de-energized, opening contacts 34-1 and terminating pilot fuel flow. The system then monitors the established flame until the operation request switch 26 opens, terminating the burner cycle.

If no flame signal voltage has been applied to bus 108, when Darlington pair 110 is turned off, control relay actuator 32 is de-energized opening contacts 32-1 and terminating ignition and fuel flow. The base voltage to transistor 172 is also removed so that that transistor ceases conduction (removing the clamp on Darlington pair 114) and an alternate lockout path is established as Darlington pair 114 is triggered into conduction through conducting transistor 142. Lockout actuator 30 thus continues to heat and at the end of its time delay, it opens normally closed contacts 30-2, shutting down the burner system, and closes normally open contacts 30-1, energizing alarm 14.

If, after establishment of normal burner operation, the flame signal disappears, indicating loss of flame, transistor 104 ceases to conduct, removing power from bus 108 and relay actuators 32 and 36 drop out. With the dropout of those relays, contacts 32-1 and 36-2 open, turning off fuel flow. However, the unlatching circuit of capacitor 182 and diode 184 couples a transition pulse to the emitter of transistor 138 to unlatch transistors 138 and 146 so that they cease conducting. The cycle of two successive timing intervals is repeated. Capacitor 124 starts charging and times a pre-ignition (purge) interval. At the end of that interval, transistors 138 and 146 are turned on and an ignition interval is timed by the discharge of capacitor 124 as described above. If flame is not re-established within that interval, the burner system goes to lockout.

Should a spurious flame signal appear during the pre-ignition timing interval (prior to the switching of Darlington pair 110 into conduction), the voltage on flame signal bus 108 is coupled through feedback resistor 130 and prevents further charging of capacitor 124. That voltage is also applied through the divider network of resistors 118, 120 and 122 to turn on Darlington pair 114, completing a heating path for lockout actuator 30. (While pilot actuator 34 is energized, pilot control 18 is not energized as control contacts 32-1 remain open, the current through the series circuit of relay coils 36 and 32 being insufficient to pull in relay 32.) If that flame signal remains on bus 108, the burner system is locked out at the end of the timing interval of lockout actuator 30 and alarm 14 is energized. Should the spurious flame signal disappear before lockout, the timing of the pre-ignition interval is reinitiated. Should there be a momentary interruption of power at terminals 10, 12, the voltage on bus 58 drops more rapidly than the voltage on bus 52 as capacitor 56 has a smaller value than capacitor 50. Thus, if such an interruption occurs after flame is established, transistors 138 and 146 promptly cease conducting and the system recycles through the pre-ignition and ignition intervals as above described when power is reapplied to terminals 10, 12.

Should the plug in card on which capacitor 124, diode 154 and resistor 158 are mounted be omitted, the circuit will lock out in response to a request for burner operation. Ground potential is applied to the base of transistor 138 through resistor 130, coils 36 and 32 and resistor 100, and thus that transistor turns on, turning on transistor 146. Darlington pair 114 is triggered into conduction by conduction of transistor 146 while Darlington pair 110 is held non-conducting as diode 154 is not in circuit. Lockout actuator 30, at the end of its time delay, opens contacts 30-2, shutting down the burner system, and closes contacts 30-1 energizing alarm 14.

Figure 2:
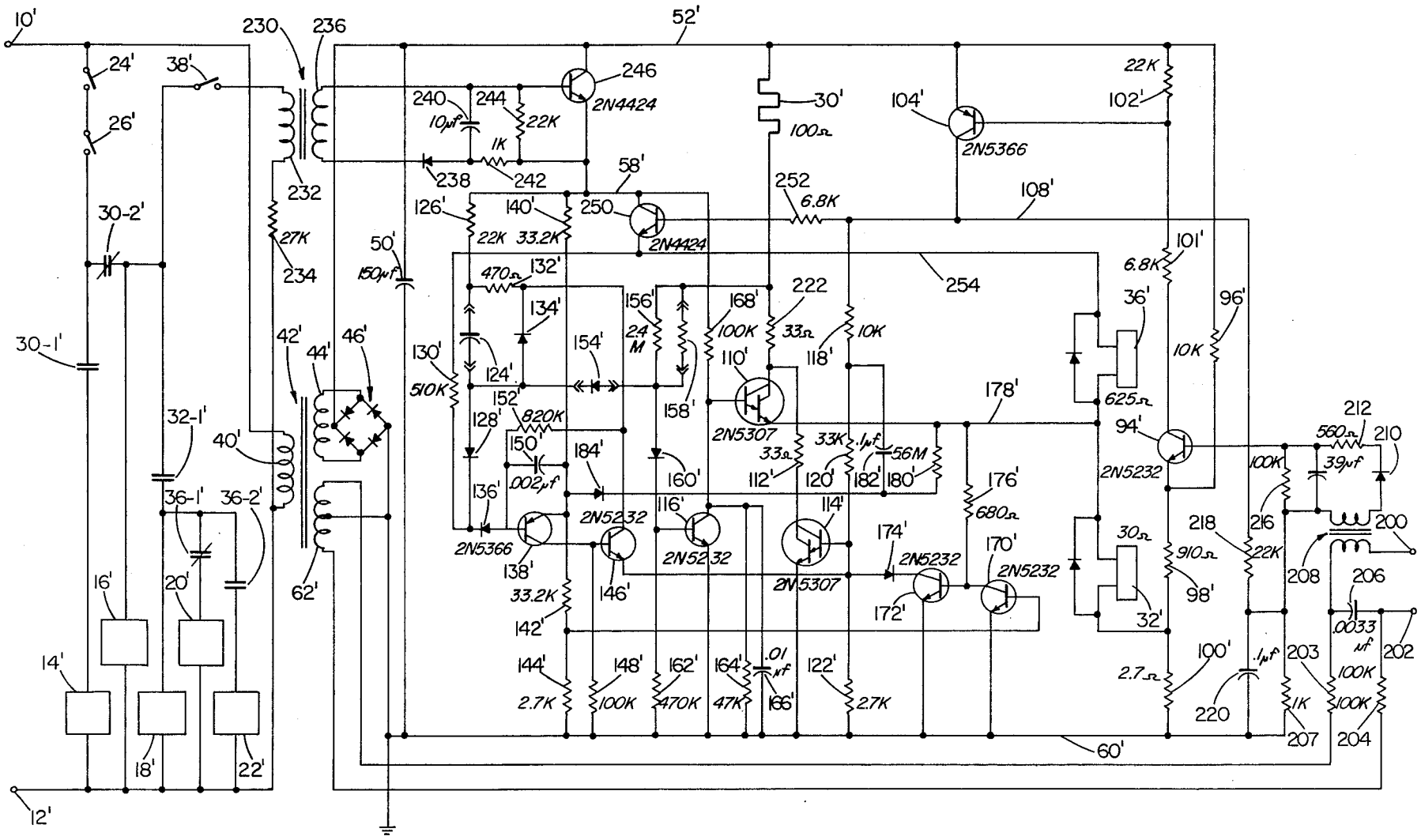
FIG. 2 is a schematic diagram of another form of burner control system constructed in accordance with aspects of the invention.

A second embodiment is shown in FIG. 2. Components that are the same or similar to those of the embodiment shown in FIG. 1 are identified by the same reference numeral with a prime appended thereto. The primary winding 40' of transformer 42' is connected directly to terminals 10', 12' so that bus 52' is continuously energized. The secondary winding 62' of that transformer supplies power to terminals 200, 202 to which a flame sensor of the UV type is connected. The flame signal pulses are coupled by transformer 208 and a rectifier circuit that includes diode 210 to the base electrode of transistor 94'. Transistor 94' in turn controls transistor 104' to apply power to flame signal bus 108'.

Should the flame sensor connected at terminals 200, 202 spuriously indicate the presence of flame in the combustion chamber, its flame signal causes conduction of transistor 104' which applies a signal through the divider network of resistors 118', 120' and 122' to raise the potential on the control electrode of Darlington pair 114' and turn on that switch, completing an energizing path for the lockout actuator 30', this energizing path being through actuator 30', resistor 222 (which is substituted for auxiliary relay coil 34 in this embodiment, although it is apparent that that pilot control may be employed if desired), resistor 112', and Darlington pair 114' to ground bus 60'. Thus lockout actuator 30' is energized even though there is no request for burner operation and if the spurious flame condition persists, the burner system will lockout, opening contacts 30-3' (preventing operation of the burner system) and closing contacts 30-1' (energizing alarm 14'). The burner control electronics do not respond and neither relay 32' or 36' is energized as there is no power on bus 58' during off heat intervals.

Auxiliary transformer 230 has its primary winding 232 connected in series with air flow switch 38' and its secondary winding 236 connected through a rectifier circuit that includes diode 238 to the base of transistor switch 246. When air flow switch 38' is closed, power is applied through transformer 230 to close switch 246 and apply B+ power from bus 52' to bus 58'.

Thus, the flame sensing and lockout circuits are continuously energized (independent of a call for heat) and in response to a call for heat and consequent operation of blower 16' to establish sufficient air flow to close switch 38', transistor 246 is triggered into conduction to apply power to bus 58' and energize the timing circuitry to commence the timing of sequential intervals controlled by the charging and discharging of capacitor 124'. As in the FIG. 1 embodiment, capacitor 124', diode 154' and resistor 158' are mounted on a plug in unit and thus enable ready change of the timing of either or both intervals. A first (pre-ignition) time interval is controlled as a function of the RC values in the capacitor charging circuit and at the end of that interval transistors 138' and 146' are triggered into conduction. As in the circuitry shown in FIG. 1, that action latches both transistors 138' and 146' and connects the plus side of capacitor 124' to resistor 122', abruptly dropping the voltage applied to diode 160'. This voltage transition turns off transistor 116' and Darlington pair 110' is switched into conduction producing current flow through lockout actuator 30', resistor 222, Darlington pair 110', bus 178', control relay coil 32' and resistor 100'. Thus, at the initiation of the second (ignition) interval heating of the lockout actuator 30' commences and simultaneously relay 32' is pulled in, initiating an ignition condition by energizing pilot fuel control 18' and spark transformer control 20'. Conduction of transistor 146' also turns off transistor 170' and the voltage on bus 178' supplied to the base of transistor 172' through resistor 176' turns on clamp transistor 172', clamping the control electrode of Darlington pair 114' to the ground bus 60' through diode 174' and preventing turn on of Darlington pair 114'. This alternate lockout actuator energizing path remains disabled as long as the transistors 138', 146' are latched in conducting condition and there is voltage on bus 178'.

As capacitor 124' discharges, the potential at the base of transistor 116' rises. After a time interval determined essentially by the value of capacitor 124' and resistor 158', transistor 116' is turned on again, turning off Darlington pair 110 and terminating the second (ignition) time interval and, if an alternate control relay energizing path (through flame relay 36') has not been established, de-energizing control relay actuator 32'. When power is removed from bus 178' clamp transistor 172' is released so that the voltage at the control electrode of Darlington pair 114' rises (transistor 146' being turned on), turning on that switch 114' and continuing the heating of lockout actuator 30' through the alternate energizing path until the end of its time delay when it opens normally closed contacts 30-2', shutting down the burner system, and closes normally open contacts 30-1', energizing alarm 14'.

This lockout sequence is interrupted by appearance of flame signal pulses at terminals 200, 202 which switches on transistors 104' and 250. The emitter of transistor switch 250 is connected to bus 254 and application of power to that bus completes an alternate relay actuator maintaining circuit through actuators 36' and 32'. The junction of diodes 128' and 136' is also brought to B+ through resistor 130'.

The flame signal on bus 108' is also applied to the divider network of resistors 118', 120' and 122' and capacitor 182' is charged. As in the circuit shown in FIG. 1, should there be a flame failure removing the flame signal from bus 108', the signal transition will be coupled by capacitor 182' and release the latched transistors 138', 146' and the circuit will automatically recycle through the two sequential timing intervals. If the unlatching circuit of capacitor 182' and diode 184' is omitted in either embodiment, flame failure will cause transistor 104' to cease conduction, the resulting absence of voltage on bus 178' will release the clamp on the control terminal of Darlington pair 114' and the alternate lockout energizing circuit will be switched into conduction because of latched transistor 146'. In such embodiments the system will lockout without recycle on flame failure.

Figure 3:
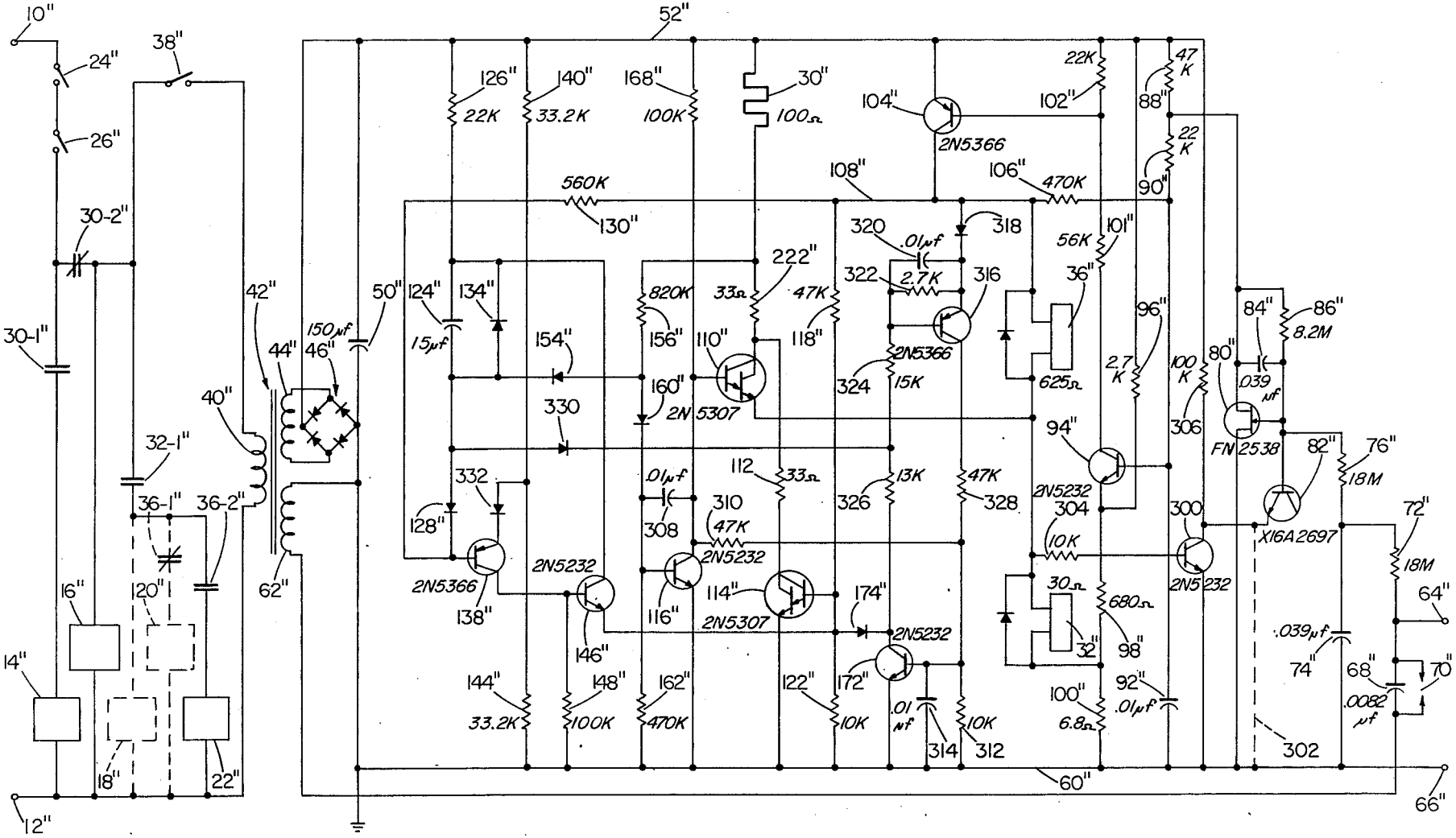
FIG. 3 is a schematic diagram of still another form of burner control system constructed in accordance with aspects of the invention.

Another embodiment is shown in FIG. 3. Components that are the same or similar to those in the embodiments shown in FIGS. 1 or 2 are identified by the same reference numeral with a double prime. The flame sensing circuit is of the same type as shown in FIG. 1 and is for use with a flame rod type of sensor. Transistor switch 300 is connected to Zener diode 82'' and provides a standing pilot interlock. In this circuit pilot control 18'' and igniter control 20'' are omitted. Switch 300 is non-conductive until an ignition sequence is initiated (control relay actuator 32' is energized) so that the gate of transistor 80" is tied to bus 52" through diode 82" and resistor 306". Thus the circuitry does not respond to the standing pilot and energize flame signal bus 108". When control relay 32" is energized at the end of the first timing interval, switch 300 is closed to connect the gate of transistor 80" to ground through diode 82" so that the flame sensing circuitry responds to the flame signal from the standing pilot to energize bus 108" and hold in control relay 32' as well as energizing flame relay 36". If the controlled burner system does not use a standing pilot, switch 300 may be bypassed as indicated by dashed line connection 302 and pilot and ignitor control 18" and 20" are connected.

In operation, when air flow switch 38" closes, power is applied to the electronic circuitry through transformer 42" and the charging of capacitor 124" commences a first timing (pre-ignition) interval. In typical applications of this particular circuitry, this first interval is a short (cold safe start) interval (of a few seconds duration) sufficient to verify the proper operation of the flame sensing circuitry (that is, that no spurious flame signal condition exists). As in the other embodiments, capacitor 124" charges until the voltage at the base of transistor 138" drops sufficiently to turn that transistor on. When transistor 138" is triggered into conduction, it triggers transistor 146" into conduction which connects the plus side of capacitor 124" to resistor 122". This action abruptly drops the voltage applied to the base of transistor 116" to turn that transistor off and turn on transistor 110", completing a current flow path that simultaneously commences heating of lockout actuator 30", energizes control relay actuator 32", and adjusts the emitter voltage of transistor 94" to compensate for the drop in B+ voltage. An ignition condition is established by igniter control 20" if that control is in circuit.

Turn off of transistor 116" also results in turn on of transistor 172" which clamps the control terminal of Darlington pair 114" to ground. Upon sensing of flame in the supervised combustion chamber, transistor 104" is switched into conduction and applies B+ voltage to bus 108" to energize flame relay actuator 36" and maintain control relay actuator 32" energized as in the other circuits. Application of power to bus 108" also switches transistor 316 into conduction so that transistor 172" is held in conduction and a reference voltage is established by divider network of resistors 324, 326. That reference voltage is coupled by diode 330 to maintain the negative terminal of capacitor 124" at slightly less than one half the B+ voltage. Transistors 138" and 146" are not latched in conducting condition but the base of transistor 138" is held at the B+ voltage on bus 108" through resistor 130".

Thus, when flame has been established, the positive terminal of capacitor 124" is at B+ (bus 52"); the negative terminal of capacitor 124" is at a voltage controlled by the divider network of resistors 324 and 326; the base of transistor 138" is held at B+ (bus 108") by resistor 130"; transistor 116" in conducting clamping the control electrode of Darlington pair 110" to ground; and the control electrode of Darlington pair 114" is clamped to ground by transistor 172" which is latched by transistor 316.

Should flame failure occur, the voltage on bus 108" is released by opening of switch 104" and the charge on capacitor 124" immediately turns on transistor 138" which turns on transistor 146". Thus the pre-ignition timing interval is omitted and the ignition interval is immediately commenced. A lockout actuator 30" and control relay 32" energizing path is completed through Darlington pair 110" and ignition control 120" is energized. This ignition condition is maintained until capacitor 120" has discharged sufficiently to allow transistor 116" to turn back on. Again, if transistor 116" turns back on before flame is re-established, Darlington pair 110" is turned off de-energizing control relay actuator 32" and de-energizing the ignition control 20". The turn on of transistor 116" also turns off transistor 172" allowing the potential of the control electrode of Darlington pair 114" to rise through the conducting transistor 146", turning that switch on and completing the alternate energizing path for lockout actuator 30". That lockout actuator continues to heat until it operates contacts 30-1" and 30-2" to shut down the burner system and operate the alarm 14".

While particular embodiments of the invention have been shown and described, various modifications thereof will be apparent to those skilled in the art, and therefore it is not intended that the invention be limited to the disclosed embodiments or to details thereof and departures may be made therefrom within the spirit and scope of the invention as defined in the claims.

What is claimed is:

1. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising a control device for actuating said fuel control means, a timing circuit for providing two successive timing intervals of precise duration, a pre-ignition timing interval and an ignition timing interval, said timing circuit having a common capacitor, one of said timing intervals being a function of the charging of said common capacitor and the other timing interval being a function of the discharging of said common capacitor, means responsive to a request for burner operation to initiate an ignition sequence by actuating said timing circuit;

circuitry responsive to said actuated timing circuit for energizing said control device at the end of said first timing interval, flame signal responsive circuitry responsive to a signal from said flame sensor to maintain said control device energized, and circuitry for preventing the production of further timing intervals by said timing circuit, and means responsive to loss of said signal from said flame sensor to cause said timing circuit to provide at least a further preignition ignition timing interval sequence.

2. The apparatus as claimed in claim 1 wherein said further timing interval preventing circuitry includes a latch circuit that is actuated in response to completion of a timing interval.

3. The apparatus as claimed in claim 2 wherein said latch circuit in actuated condition maintains said common capacitor in discharged condition.

4. The apparatus as claimed in claim 1 wherein said further timing interval preventing circuitry is responsive to a signal from said flame sensor.

5. The apparatus as claimed in claim 1 wherein said further timing interval preventing circuitry maintains said common capacitor in charged condition.

6. The apparatus as claimed in claim 1 wherein said control device energizing circuitry also energizes lockout circuitry and further including compensating means to provide power supply compensation to stabilize the sensitivity of said flame signal responsive circuitry during the concurrent energization of said lockout circuitry and said control device.

7. The apparatus as claimed in claim 6 wherein said flame signal responsive circuitry includes a reference voltage provided by a voltage divider network for connection to the power supply for said control circuitry and said compensation means is connected to shift the voltage on said divider network and stabilize said reference voltage.

8. The apparatus as claimed in claim 1 and further including lockout circuitry for de-energizing said control apparatus comprising a switch, an actuator for operating said switch and two alternate paths for energizing said actuator, said control device is connected in one of said lockout actuator energizing paths, said timing circuit energizes said one lockout actuator energizing path at the end of said first timing interval, and said timing circuit de-energizes said one lockout actuator energizing path and energizes the other lockout actuator energizing path at the end of said other timing interval in the absence of a signal from said flame sensor.

9. The apparatus as claimed in claim 8 and further including a fuel control device connected in said one lockout actuator energizing path for controlling the flow of pilot fuel to the fuel burner installation.

10. The apparatus as claimed in claim 8 and further including terminal means for connecting said lockout circuitry directly to a power supply so that power is supplied to said lockout circuitry independently of a request for burner operation, means responsive to a request for burner operation to connect said timing circuit to said terminal means to initiate an ignition sequence, said timing circuit being energized only during the duration of a request for burner operation, means responsive to a signal from said flame sensor when said control device is not energized to energize said lockout circuitry and to prevent energization of said control device, means responsive to a signal from said flame sensor when said control device has been energized by said timing circuit to maintain said control device energized, and means responsive to the end of said ignition timing interval to de-energize said control device and to energize said lockout circuitry in the absence of a signal from said flame sensor.

11. The apparatus as claimed in claim 1 wherein said common capacitor is mounted on a plug in unit.

12. The apparatus as claimed in claim 11 wherein also mounted on said plug in unit is a resistor that cooperates with said common capacitor in determining the duration of a timing interval provided by said timing circuit.

13. The apparatus as claimed in claim 1 wherein said flame signal processing circuitry includes a solid state device that has a control electrode, a voltage limiting device connected to said control electrode, and means responsive to energization of said control device for switching said voltage limiting device between a positive potential when said control is not energized and a ground potential when said control device is energized.

14. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising a control device for actuating said fuel control means, a timing circuit for providing two successive timing intervals of precise duration, a preignition timing interval and an ignition timing interval, said timing circuit having a common capacitor and a resistor that cooperates with said common capacitor in determining the duration of a timing interval provided by said timing circuit, one of said timing intervals being a function of the charging of said common capacitor and the other timing interval being a functon of the discharging of said common capacitor, means responsive to a request for burner operation to initiate an ignition sequence by actuating said timing circuit;

circuitry responsive to said actuated timing citcuit for energizing said control device at the end of said first timing interval, flame signal responsive circuitry responsive to a signal from said flame sensor to maintain said control device energized, circuitry for preventing the production of further timing intervals by said timing circuit, means responsive to loss of said signal from said flame sensor to cause said timing circuit to provide at least a further ignition timing interval, lockout circuitry for de-energizing said control apparatus and a plug in unit, said plug in unit including said common capacitor, said resistor, and a further circuit component, said further circuit component being connected between said timing circuit and said lockout circuitry when said plug in unit is inserted in said control apparatus, said timing circuit and said lockout circuitry being arranged so that, when said plug in unit is not inserted in said control apparatus, said lockout circuitry is energized in response to a request for burner operation and energization of said control device is prevented.

15. Burner control apparatus for use with a fuel burner installation having an operating control to produce a request for burner operation, a flame sensor to produce a signal when flame is present in said fuel burner installation ignition control means, and means responsive to said burner control apparatus for controlling fuel flow to said fuel burner installation, said burner control apparatus comprising lockout apparatus for de-energizing said control apparatus, a control device for actuating said ignition control means, control circuitry including a timing circuit for providing an ignition timing interval, means responsive to a request for burner operation to initiate an ignition sequence by actuating said timing circuit, circuitry responsive to said actuated timing circuit for energizing concurrently said control device and said lockout apparatus at the beginning of said ignition timing interval, flame signal responsive circuitry responsive to a signal from said flame sensor to maintain said control device energized, and compensating means to provide power supply compensation for said concurrent energization to stabilize the sensitivity of said flame signal responsive circuitry during the concurrent energization of said lockout apparatus and said control device.

16. Burner control apparatus for use with a fuel burner installation having an operating control to produce a request for burner operation, a flame sensor to produce a signal when flame is present in said fuel burner installation, ignition control means, and means responsive to said burner control apparatus for controlling fuel flow to said fuel burner installation, said burner control apparatus comprising lockout apparatus for de-energizing said control apparatus, a control device for actuating said ignition control means, control circuitry including a timing circuit for providing an ignition timing interval, means responsive to a request for burner operation to initiate an ignition sequence by actuating said timing circuit, circuitry responsive to said actuated timing circuit for energizing concurrently said control device and said lockout apparatus at the beginning of said ignition timing interval, flame signal responsive circuitry responsive to a signal from said flame sensor to maintain said control device energized and including a voltage divider network for connection to the power supply for said control circuitry to provide a reference voltage, and compensating means to provide power supply compensation for said concurrent energization connected to shift the voltage on said divider network to stabilize said reference voltage and the sensitivity of said flame signal responsive circuitry during the concurrent energization of said lockout apparatus and said control device.

17. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising lockout circuitry for de-energizing said control apparatus, terminal means for connecting said lockout circuitry directly to a power supply so that power is supplied to said lockout circuitry independently of a request for burner operation, a control device for actuating said fuel control means, control circuitry including a timing circuit for providing an ignition timing interval, means responsive to a request for burner operation to connect said control circuitry to said power supply to initiate an ignition sequence, said control circuitry being energized only during the duration of a request for burner operation, circuitry responsive to said actuated control circuitry for energizing said control device, means responsive to a signal from said flame sensor when said control device is not energized to energize said lockout circuitry and to prevent energization of said control device, means responsive to a signal from said flame sensor when said control device has been energized by said control circuitry to maintain said control device energized, an means responsive to the end of said ignition timing interval to de-energize said control device and to energize said lockout circuitry in the absence of a signal from said flame sensor.

18. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising lockout circuitry for de-energizing said control apparatus comprising a switch, an actuator for operating said switch and two alternate paths for energizing said actuator, terminal means for connecting said lockout circuitry directly to a power supply so that power is supplied to said lockout circuitry independently of a request for burner operation, a control device for actuating said fuel control means, said control device being connected in one of said lockout actuator energizing paths, control circuitry including a timing circuit for providing an ignition timing interval, said timing circuit energizing said one lockout actuator energizing path at the beginning of said ignition timing interval, said timing circuit de-energizing said one lockout actuator energizing path and energizing the other lockout actuator energizing path at the end of said ignition timing interval in the absence of a signal from said flame sensor, means responsive to a request for burner operation to connect said control circuitry to said power supply to initiate an ignition sequence, said control circuitry being energized only during the duration of a request for burner operation, circuitry responsive to said actuated control circuitry for energizing said control device, means responsive to a signal from said flame sensor when said control device is not energized to energize said other lockout actuator energizing path and to prevent energization of said control device, means responsive to a signal from said flame sensor when said control device has been energized by said control circuitry to maintain said control device energized, and means responsive to the end of said ignition timing interval to de-energize said control device and to energize said lockout circuitry in the absence of a signal from said flame sensor.

19. The apparatus as claimed in claim 18 and further including flame signal responsive circuitry for connection to said flame sensor, and further including compensating means to provide power supply compensation to stabilize the sensitivity of said flame signal responsive circuitry during the concurrent energization of said lockout circuitry and said control device.

20. The apparatus as claimed in claim 19 wherein said flame signal responsive circuitry includes a reference voltage provided by a voltage divider network connected to the power supply for said control circuitry and said compensation means is connected to shift the voltage on said divider network and stabilize said reference voltage.

21. The apparatus as claimed in claim 20 wherein said timing circuitry includes a capacitor and a resistor, said capacitor and said resistor being mounted on a plug in unit, one said plug in unit includes a further circuit component, said further circuit component being connected between said timing circuit and said lockout circuitry when said plug in unit is inserted in said control circuitry, said timing circuit and said lockout circuitry being arranged so that, when said plug in unit is not inserted in said control apparatus, said lockout circuitry is energized in response to a request for burner operation and energization of said control device is prevented.

22. The apparatus as claimed in claim 21 wherein said timing circuit provides two successive timing intervals of precise duration, a pre-ignition timing interval and an ignition timing interval, one of said timing intervals being a function of the charging of said capacitor and the other timing interval being a function of the discharging of said capacitor, and further including circuitry for preventing the production of further timing intervals by said timing circuit, and means responsive to loss of said signal from said flame sensor to cause said timing circuit to provide at least a further ignition timing interval.

23. The apparatus as claimed in claim 22 wherein said further timing interval preventing circuitry includes a latch circuit that is actuated in response to completion of a timing interval, said latch circuit in actuated condition maintaining said common capacitor in discharged condition.

24. The apparatus as claimed in claim 22 wherein said further timing interval preventing circuitry is responsive to a signal from said flame sensor, and maintains said common capacitor in charged condition.

25. The apparatus as claimed in claim 22 wherein said lockout circuitry includes a lockout actuator and two alternate paths for energizing said lockout actuator and further including a pilot fuel control connected in one of said lockout actuator energizing paths in series with said control device.

26. Burner control apparatus for use with a fuel burner installation having an operating control to produce a request for burner operation, a flame sensor to produce a signal when flame is present in said fuel burner installation, and means responsive to said burner control apparatus for controlling fuel flow and fuel ignition, said burner control apparatus comprising lockout circuitry for de-energizing said control apparatus comprising a switch and an actuator for operating said switch after a time delay, a main control device for actuating said fuel and ignition control means, a pilot fuel control device connected in a series circuit with said lockout actuator and said main control device for energization concurrent therewith, a timing circuit, means responsive to a request for burner operation to initiate an ignition interval by actuating said timing circuit;

circuitry responsive to said actuated timing circuit for energizing said series circuit at the beginning of said ignition interval, flame signal responsive circuitry responsive to a signal from said flame sensor to maintain said control device energized, and means responsive to the end of said ignition interval to de-energize said series circuit and to energize said lockout actuator in the absence of a signal from said flame sensor.

27. The apparatus as claimed in claim 26 and further including compensating means to provide power supply compensation to stabilize the sensitivity of said flame signal responsive circuitry during the concurrent energization of said lockout circuitry and said control device.

28. The apparatus as claimed in claim 27 wherein said flame signal responsive circuitry includes a reference voltage provided by a voltage divider network for connection to the power supply for said control circuitry and said compensation means is connected to shift the voltage on said divider network and stabilize said reference voltage.

29. Burner control apparatus for use with a fuel burner installation having an operating control to produce a request for burner operation, a flame sensor to produce a signal when flame is present in said fuel burner installation, and means responsive to said burner control apparatus for controlling fuel flow and fuel ignition, said burner control apparatus comprising lockout circuitry for de-energizing said control apparatus comprising a switch and an actuator for operating said switch after a time delay, a main control device for actuating said fuel and ignition control means, a pilot fuel control device connected in a series circuit with said lockout actuator and said main control device for energization concurrent therewith, a timing circuit, said timing circuit providing two successive timing intervals of precise duration, a preignition timing interval and an ignition timing interval, one of said timing intervals being a function of the charging of a capacitor and the other timing interval being a function of the discharging of said capacitor, means responsive to a request for burner operation to initiate an ignition interval by actuating said timing circuit;

circuitry responsive to said actuated timing circuit for energizing said series circuit at the beginning of said ignition interval, flame signal responsive circuitry responsive to a signal from said flame sensor to maintain said control device energized, compensating means to provide power supply compensation to stabilize the sensitivity of said flame signal responsive circuitry during the concurrent energization of said lockout circuitry and said control device, circuitry responsive to loss of a flame signal from said flame sensor flame has been established to cause said timing circuit to provide at least a further ignition timing interval, and means responsive to the end of said ignition interval to de-energize said series circuit and to energize said lockout actuator in the absence of a signal from said flame sensor.

30. The apparatus as claimed in claim 29 wherein said lockout circuitry for de-energizing said control apparatus comprises a switch, an actuator for operating said switch and two alternate paths for energizing said actuator, said control device is connected in one of said lockout actuator energizing paths.

said timing circuit energizes said one lockout actuator energizing path at the beginning of said ignition timing interval, said timing circuit de-energizes said one lockout actuator energizing path and energizes the other lockout actuator energizing path at the end of said ignition timing interval in the absence of a signal from said flame sensor.

31. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising lockout circuitry for de-energizing said control apparatus, a control device for actuating said fuel control means, flame signal processing circuitry responsive to a signal from said flame sensor and including a solid state device that has a control electrode, a voltage limiting device connected to said control electrode, said voltage limiting device being normally connected to an inhibiting potential, means responsive to energization of said control device for switching said voltage limiting device to a gating potential a timing circuit, means responsive to a request for burner operation to initiate an ignition interval by actuating said timing circuit;

circuitry responsive to said actuated timing circuit for energizing said control device at the beginning of said ignition interval, flame signal responsive circuitry responsive to a signal from said flame sensor to maintain said control device energized, and means responsive to the end of said ignition interval to de-energize said control device and to energize said lockout circuitry in the absence of a signal from said flame sensor.

32. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising lockout circuitry for de-energizing said control apparatus, a control device for actuating said fuel control means, control circuitry including a timing circuit for providing an ignition timing interval, a plug in unit for manual insertion into and removal from said control circuitry, said plug in unit including a capacitor and a further circuit component, said capacitor being connected in said timing circuit and controlling the duration of said ignition timing interval and said further circuit component being connected between said timing circuit and said lockout circuitry when said plug in unit is inserted in said control circuitry, said timing circuit and said lockout circuitry being arranged so that, when said plug in unit is not inserted in said control circuitry, said lockout circuitry is energized in response to a request for burner operation and energization of said control device is prevented, means responsive to a request for burner operation when said plug in unit is inserted in said control circuitry to initiate an ignition sequence, circuitry responsive to said actuated control circuitry for energizing said control device, means responsive to a signal from said flame sensor when said control device is not energized to energize said lockout circuitry and to prevent energization of said control device, means responsive to a signal from said flame sensor when said control device has been energized by said control circuitry to maintain said control device energized, and means responsive to the end of said ignition timing interval to de-energize said control device and to energize said lockout circuitry in the absence of a signal from said flame sensor.

33. The apparatus as claimed in claim 32 and further including flame signal responsive circuitry for connection to said flame sensor, said flame signal responsive circuitry including a reference voltage provided by a voltage divider network for connection to the power supply for said control circuitry and further including compensating means to provide power supply compensation to stabilize the sensitivity of said flame signal responsive circuitry during the concurrent energization of said lockout circuitry and said control device, said compensation means is connected to shift the voltage on said divider network and stabilize said reference voltage.

34. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising lockout circuitry for de-energizing said control apparatus, a control device for actuating said fuel control means, control circuitry including a timing circuit for providing an ignition timing interval, a plug in unit for manual insertion into and removal from said control circuitry, said plug in unit including a capacitor and a further circuit component, said timing circuit providing two successive timing intervals of precise duration, a pre-ignition timing interval and an ignition timing interval, one of said timing intervals being a function of the charging of said capacitor and the other timing interval being a function of the discharging of said capacitor, and said further circuit component being connected between said timing circuit and said lockout circuitry when said plug in unit is inserted in said control circuitry, said timing circuit and said lockout circuitry being arranged so that, when said plug in unit is not inserted in said control circuitry, said lockout circuitry is energized in response to a request for burner operation and energization of said control device is prevented, means responsive to a request for burner operation when said plug in unit is inserted in said control circuitry to initiate an ignition sequence, circuitry responsive to said actuated control circuitry for energizing said control device, means responsive to a signal from said flame sensor when said control device is not energized to energize said lockout circuitry and to prevent energization of said control device, means responsive to a signal from said flame sensor when said control device has been energized by said control circuitry to maintain said control device energized, means responsive to the end of said ignition timing interval to de-energize said control device and to energize said lockout circuitry in the absence of a signal from said flame sensor, circuitry for preventing the production of further timing intervals by said timing circuit, and means responsive to loss of said signal from said flame sensor to cause said timing circuit to provide at least a further ignition timing interval.

35. The apparatus as claimed in claim 34 wherein said further timing interval preventing circuitry includes a latch circuit that is actuated in response to completion of a timing interval, said latch circuit in actuated condition maintaining said common capacitor in discharged condition.

36. The apparatus as claimed in claim 34 wherein said further timing interval preventing circuitry is responsive to a signal from said flame sensor, and maintains said common capacitor in charged condition.

37. Burner control apparatus for use with a fuel burner installation having an operating control to produce a request for burner operation, a flame sensor to produce a signal when flame is present in said fuel burner installation, and means responsive to said burner control apparatus for controlling fuel flow, said burner control apparatus comprising lockout circuitry for de-energizing said control apparatus, said lockout circuitry comprising a switch, an actuator for operating said switch and two alternate paths for energizing said actuator, a control device for actuating said fuel control means, said control device being connected in one of said lockout actuator energizing paths, control circuitry including a timing circuit for providing an ignition timing interval, said timing circuit energizing said one lockout actuator energizing path at the beginning of said ignition timing interval, said timing circuit de-energizing said one lockout actuator energizing path and energizing the other lockout actuator energizing path at the end of said ignition timing interval in the absence of a signal from said flame sensor, a plug in unit for manual insertion into and removal from said control circuitry, said plug in unit including a capacitor and a further circuit component, said capacitor being connected in said timing circuit and controlling the duration of said ignition timing interval and said further circuit component being connected between said timing circuit and said lockout circuitry when said plug in unit is inserted in said control circuitry, said timing circuit and said lockout circuitry being arranged so that, when said plug in unit is not inserted in said control circuitry, said other lockout actuator energizing path is energized in response to a request for burner operation and energization of said control device is prevented, means responsive to a request for burner operation when said plug in unit is inserted in said control circuitry to initiate an ignition sequence, circuitry response to said actuated control circuitry for energizing said control device, means responsive to a signal from said flame sensor when said control device is not energized to energize said other lockout actuator energizing path and to prevent energization of said control device, means responsive to a signal from said flame sensor when said control device has been energized by said control circuitry to maintain said control device energized, and means responsive to the end of said ignition timing interval to de-energize said control device and to energize said lockout circuitry in the absence of a signal from said flame sensor.

* * * * *

UNITED STATES PATENT AND TRADEMARK OFFICE

CERTIFICATE OF CORRECTION

PATENT NO. : 4,113,419

DATED : September 12, 1978

INVENTOR(S) : Phillip J. Cade

It is certified that error appears in the above-identified patent and that said Letters Patent are hereby corrected as shown below:

Column 5, line 34, "154 to 160" should be --154 and 160--;

Column 7, line, 36, "contacts 30-3'" should be --contacts 30-2'--;

Column 10, line 57, "preignition ignition" should be --preignition and ignition--;

Column 12, line 21, "functon" should be --function--;

Column 12, line 26, "citcuit" should be --circuit--;

Column 14, line 7, ", an" should be --, and --;

UNITED STATES PATENT AND TRADEMARK OFFICE

CERTIFICATE OF CORRECTION

PATENT NO. : 4,113,419

DATED : September 12, 1978

INVENTOR(S) : Phillip J. Cade

It is certified that error appears in the above-identified patent and that said Letters Patent are hereby corrected as shown below:

Column 16, line 55-56, "flame sensor flame" should be --flame sensor after flame--;

Column 16, line 68, "path." should be --path,--;

Column 17, line 27, "gating potential a timing circuit." should be --gating potential, a timing circuit,--

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*